US007722326B2

(12) United States Patent
Beeck et al.

(10) Patent No.: US 7,722,326 B2
(45) Date of Patent: May 25, 2010

(54) INTENSIVELY COOLED TRAILING EDGE OF THIN AIRFOILS FOR TURBINE ENGINES

(75) Inventors: Alexander R. Beeck, Orlando, FL (US); Sanjay Chopra, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 565 days.

(21) Appl. No.: 11/717,238

(22) Filed: Mar. 13, 2007

(65) Prior Publication Data

US 2008/0226461 A1 Sep. 18, 2008

(51) Int. Cl.
*F01D 5/18* (2006.01)

(52) U.S. Cl. ..... 416/97 R; 416/92

(58) Field of Classification Search ..... 415/115–116; 416/90 R, 92, 96 R, 96 A, 97 R
See application file for complete search history.

(56) References Cited

U.S. PATENT DOCUMENTS 3,051,439 A * 8/1962 Hilton ..... 416/97 R
3,427,001 A * 2/1969 Malley et al. ..... 416/92
3,644,059 A 2/1972 Bryan
3,782,852 A * 1/1974 Moore ..... 416/97 R
3,899,267 A * 8/1975 Dennis et al. ..... 416/92
4,229,140 A 10/1980 Scott
4,297,077 A 10/1981 Durgin et al.
4,601,638 A 7/1986 Hill et al.
5,102,299 A 4/1992 Frederick
5,288,207 A 2/1994 Linask
5,378,108 A 1/1995 Zelesky
5,536,143 A 7/1996 Jacala et al.
5,599,166 A 2/1997 Deptowicz et al.
6,174,134 B1 1/2001 Lee et al.
6,382,908 B1 5/2002 Keith et al.
6,439,837 B1 8/2002 Heyward et al.
6,478,535 B1 11/2002 Chung et al.
6,969,230 B2 11/2005 Shi et al.
6,974,308 B2 12/2005 Halfmann et al.
2006/0056969 A1 3/2006 Jacala et al.

* cited by examiner

*Primary Examiner*—Christopher Verdier

(57) ABSTRACT

A cooling system designed to cool the trailing edge of a turbine blade usable in rear stages of a turbine engine. The turbine blade may have a leading edge cooling cavity and a trailing edge cooling cavity separated by an impingement rib. The cooling system may exhaust cooling fluids through the tip of the turbine blade rather than through the trailing edge of the turbine blade to prevent premature failure at the trailing edge of the turbine blade.

20 Claims, 6 Drawing Sheets

INTENSIVELY COOLED TRAILING EDGE OF THIN AIRFOILS FOR TURBINE ENGINES

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion. A turbine blade ordinarily includes a tip opposite to the root section, a leading edge, and a trailing edge. The inner aspects of turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature.

The trailing edge of a turbine blade is difficult to cool because the trailing edge is often too thin to effectively cool using known embodiments. Because the trailing edge of a blade is difficult to cool and is often exposed to both high temperatures and high loads, the trailing edge may suffer from creep or oxidation during operation. The detrimental effects may be most pronounced in the radially outward portion of the blade proximate to the blade tip because the elongated airfoil is thinner at the tip. The problem is generally most severe in the rear stages of a turbine where the entire elongated airfoil is generally thinner than the elongated airfoils of the front stages. Thus, a need exists for a turbine blade cooling system that effectively cools the trailing edge of a rear stage turbine blade.

SUMMARY OF THE INVENTION

The present invention is directed to a turbine blade cooling system designed to cool the trailing edge of a turbine blade usable in rear stages of a turbine engine. The cooling system may be configured to cool aspects of the trailing edge despite the relative thin thickness of the turbine blade proximate to the trailing edge. In particular, the cooling system may exhaust cooling fluids through the tip rather than through the trailing edge, thereby not further weakening the region of the airfoil proximate to the trailing edge.

The turbine blade may include a leading edge cooling cavity and a trailing edge cooling cavity separated by an impingement rib with impingement orifices therein. The trailing edge cooling cavity may be in fluid communication with the exterior of the blade through at least one exhaust orifice in the tip of the blade. The trailing edge cooling cavity may be designed such that cooling fluid passing from the leading edge cooling cavity to the trailing edge cooling cavity impinges on a trailing edge cooling cavity surface proximate to the trailing edge. The trailing edge cooling cavity may also be designed so that a cooling fluid is drawn from the leading edge cooling cavity and into the trailing edge cooling cavity before exiting through the exhaust orifices in the blade tip.

The turbine blade may include a generally elongated blade having a leading edge, a trailing edge, and a tip at a first end. A platform may be located generally orthogonal to the generally elongated blade and proximate an end of the generally elongated blade opposite the tip. The blade may include a leading edge cooling cavity disposed generally spanwise within the generally elongated blade and may have a portion located proximate the leading edge. A trailing edge cooling cavity may be disposed generally spanwise within the generally elongated blade and may have a portion located proximate the trailing edge. The cross-sectional area of the trailing edge cooling cavity taken generally orthogonal to a radial axis of the generally elongated blade may generally increase moving from a radially inward end of the trailing edge cooling cavity toward a radially outward end of the trailing edge cooling cavity. The blade tip may include an exhaust orifice having a first opening in fluid communication with the trailing edge cooling cavity and a second opening located in an outer surface of the generally elongated blade. The blade may include an impingement rib separating the leading edge cooling cavity from the trailing edge cooling cavity and extending generally spanwise along the generally elongated blade. The impingement rib may include an impingement orifice positioned with the first opening of the impingement orifice in fluid communication with the leading edge cooling cavity and the second opening of the impingement orifice in fluid communication with the trailing edge cooling cavity.

In one embodiment, the impingement rib may include a plurality of impingement orifices. The plurality of impingement orifices may be asymmetrically distributed along the length of the impingement rib. The density of the impingement orifices may decrease moving from the end of the generally elongated blade proximate the platform toward the tip.

The cross-sectional area of the impingement orifices may decrease moving from the end of the generally elongated blade proximate the platform toward the tip. The cross-sectional area of the impingement orifices may decrease non-linearly.

The turbine blade may include a plurality of exhaust orifices in the blade tip. The total cross-sectional area of the impingement orifice openings may be less than, equal to, or greater than a total cross-sectional area of the exhaust orifice openings. If there is more than one exhaust orifice, the exhaust orifices may be distributed asymmetrically along the length of the blade tip.

The cross-sectional area of the leading edge cooling cavity taken generally orthogonal to the radial axis of the generally elongated blade may decrease moving from the radially inward end of the leading edge cooling cavity toward the radially outward end of the leading edge cooling cavity. The cross-sectional area of the leading edge cooling cavity may decrease non-linearly.

An advantage of this invention is that the cooling system enables the trailing edge region of a rear stage turbine blade to be adequately cooled without further weakening the region.

Another advantage of this invention is that the cooling system may provide impingement cooling to the trailing edge of the turbine blade.

Yet another advantage of the invention is that the trailing edge cooling cavity may be designed so that the impingement effect is not distorted by the cross-flow of cooling fluid.

Another advantage of the invention is that the cooling system provides improved convective cooling of the trailing edge by increasing the flow of cooling fluid in the trailing edge cooling cavity proximate to the trailing edge of the blade.

These and other embodiments are described in more detail below.

BRIEF DESCRIPTION OF THE DRAWINGS

Other objects, features and advantages of the present invention will become apparent upon reading the following detailed description, while referring to the attached drawings, in which.

DETAILED DESCRIPTION OF THE INVENTION

Figure 1:
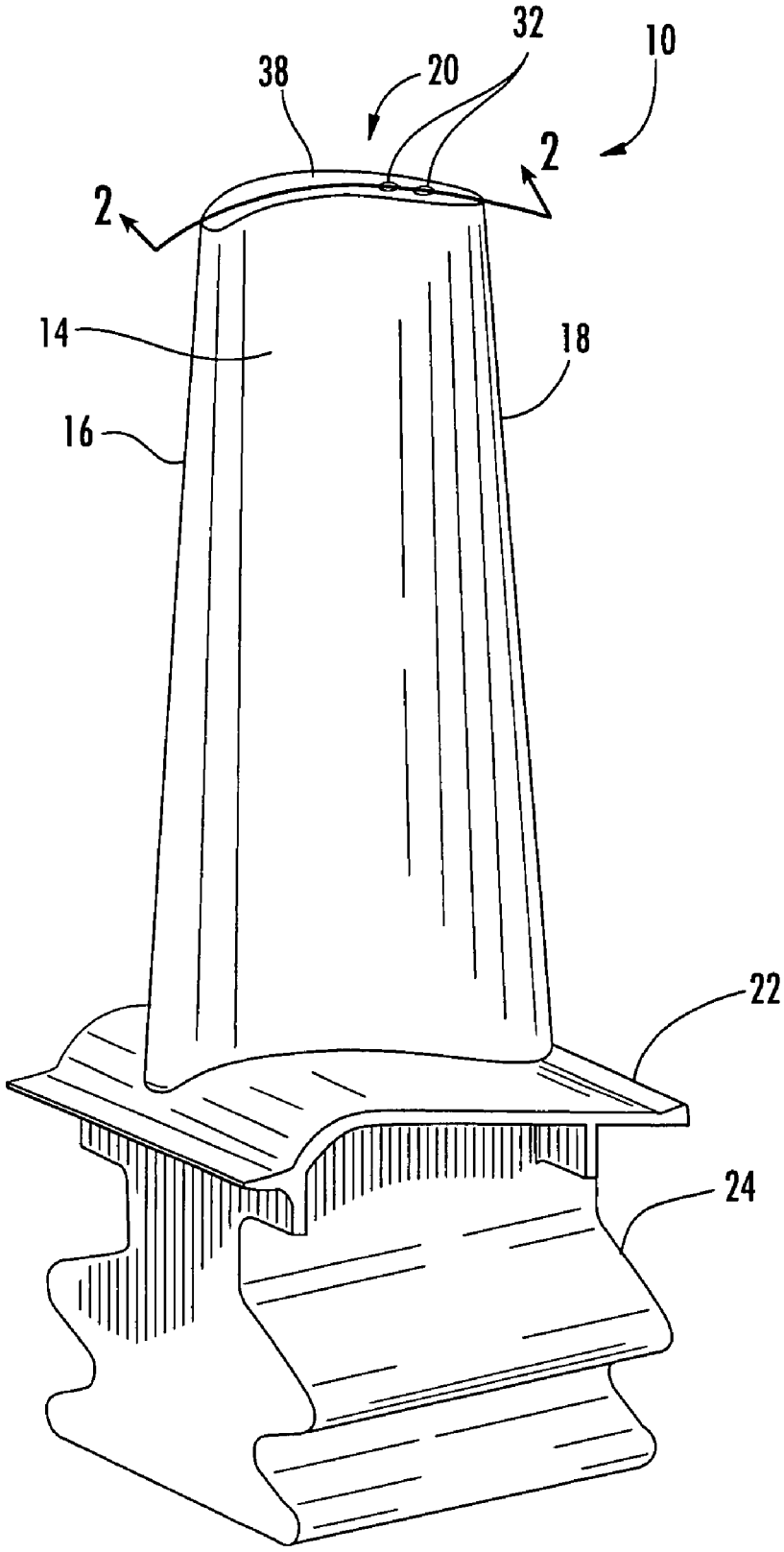
FIG. 1 is a perspective view of the a turbine blade containing a trailing edge cooling system of the present invention.

As shown in FIGS. 1-8, this invention is directed to a cooling system 12 usable in a turbine blade 10 that is configured to be used in rear stages of a turbine of a turbine engine. The cooling system 12 may be configured to cool aspects of the trailing edge 18 despite the relatively thin thickness of the turbine blade 10 proximate to the trailing edge 18. In particular, the cooling system 12 may exhaust cooling fluids through the tip 20 rather than through the trailing edge 18, thereby not further weakening the region of the airfoil 10 proximate to the trailing edge 18.

Figure 2:
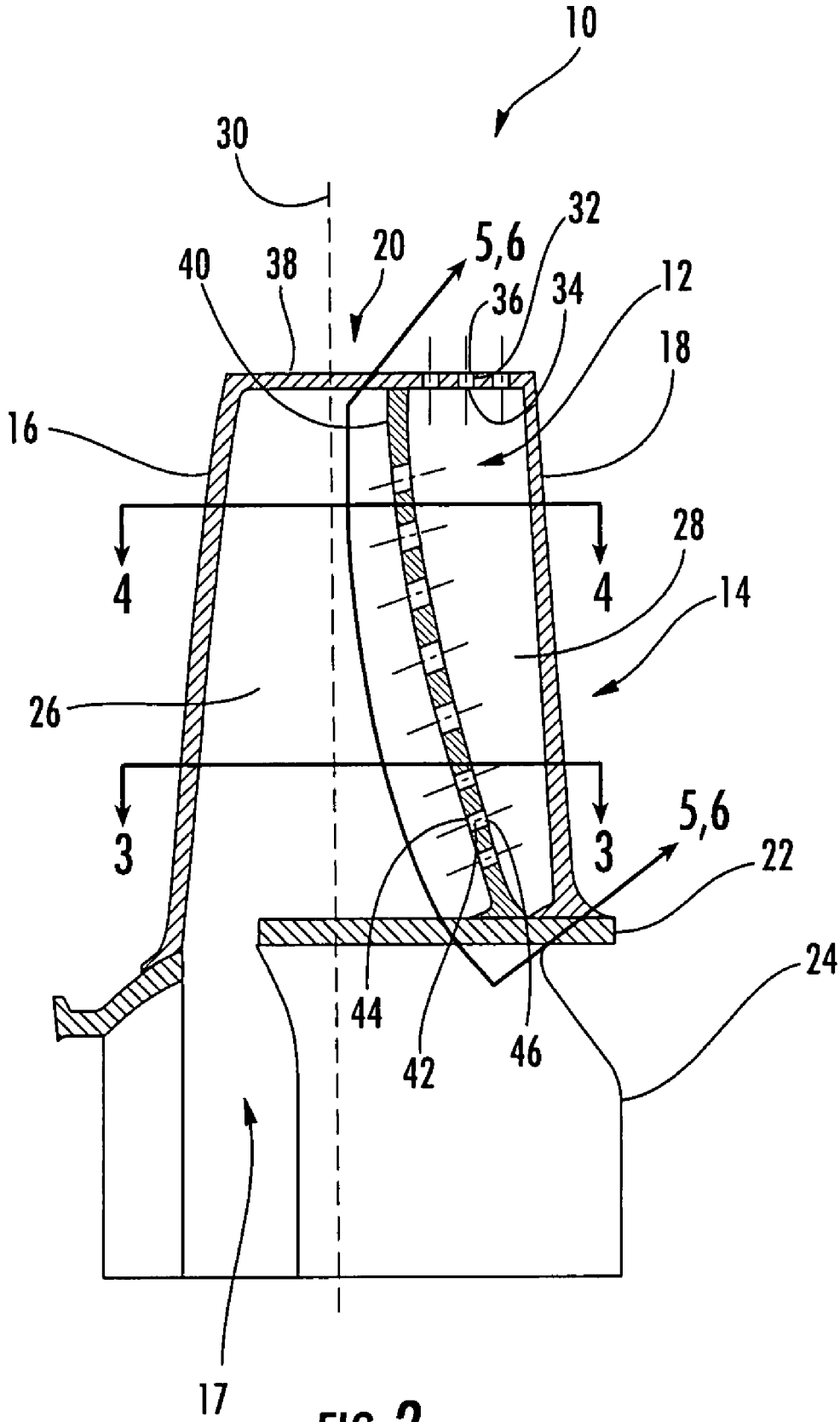
FIG. 2 is a cross-sectional view of the turbine blade of FIG. 1, taken along section line 2-2, that shows a turbine airfoil having a leading edge cooling cavity, a trailing edge cooling cavity, an impingement rib, impingement orifices and exhaust orifices.
Figure 3:
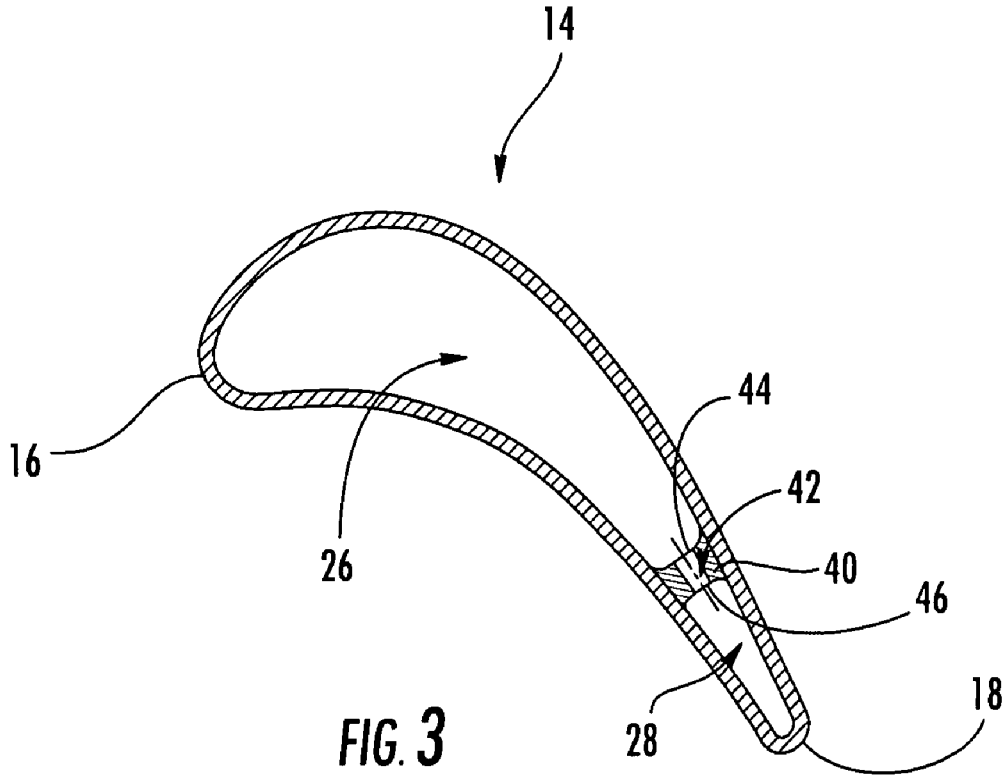
FIG. 3 is a cross-sectional view of the turbine blade of FIG. 2, taken along section line 3-3, that shows a turbine airfoil having a trailing edge cooling cavity.
Figure 4:
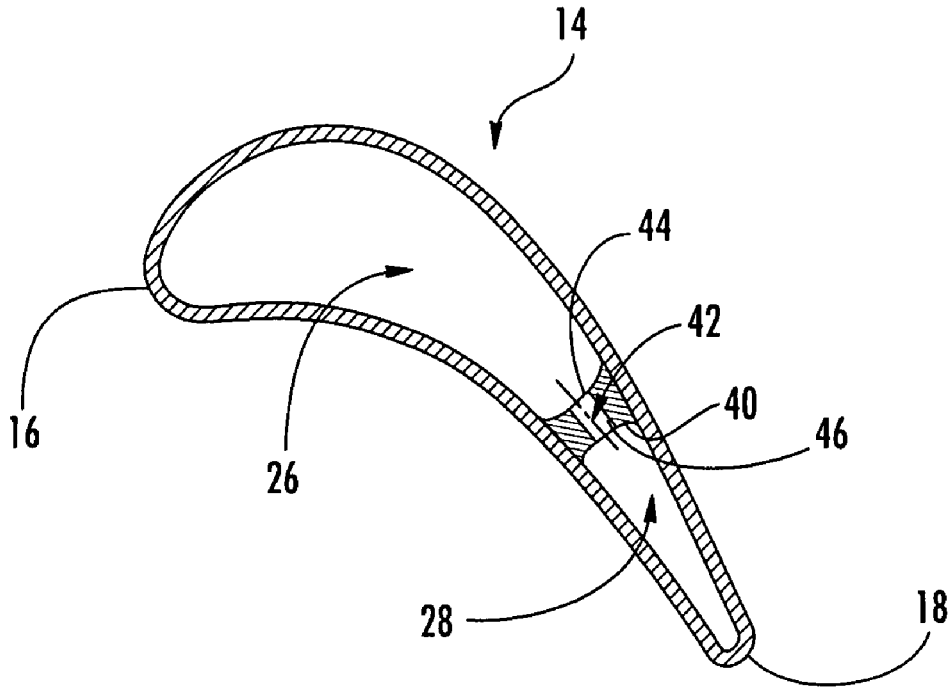
FIG. 4 is a cross-sectional view of the turbine blade of FIG. 2, taken along section line 4-4, that shows a turbine airfoil having a trailing edge cooling cavity with a cross-sectional area larger than a cross-sectional area of the trailing edge cooling cavity shown in FIG. 3.

In one embodiment, the turbine blade 10 may include a generally elongated blade 14 having a leading edge 16, a trailing edge 18, a tip 20, and a platform 22 that is positioned generally orthogonal to the generally elongated blade 14 and located at an end of the generally elongated blade 14 opposite the tip 20. The trailing edge 18 may be a nonperforated trailing edge 18 that lacks any exhaust orifices, as shown in FIG. 2. The turbine airfoil may also include a root 24 positioned proximate to the platform 22. A leading edge cooling cavity 26 may extend generally spanwise within the generally elongated blade 14 with a portion located proximate to the leading edge 16. A trailing edge cooling cavity 28 may be disposed generally spanwise within the generally elongated blade 14 and may have a portion located proximate to the trailing edge 18. As shown in FIGS. 3 & 4, the cross-sectional area of the trailing edge cooling cavity 28 taken generally orthogonal to a radial axis 30 of the generally elongated blade 14 may generally increase moving from the radially inward end of the trailing edge cooling cavity 28, as shown in FIG. 3, to the radially outward end of the trailing edge cooling cavity 28, as shown in FIG. 4.

Although not shown, the cross-sectional area of the trailing edge cooling cavity 28 taken generally orthogonal to a radial axis 30 of the generally elongated blade 14 may remain constant or even decrease over a portion of the trailing edge cooling cavity 28 moving from the radially inward end of the trailing edge cooling cavity 28. As used herein, "generally increases" indicates that along at least 50%, preferably along at least 75%, more preferably along at least 85%, of the length of the trailing edge cooling cavity 28, the cross-sectional area increases relative an the immediately adjacent portion of the trailing edge cooling cavity 28.

In an embodiment of the present invention, the cross-section of the trailing edge cooling cavity 28 may be constant or even decrease over a portion of the trailing edge cooling cavity 28 proximate the blade tip 20. This may be used to optimize cooling near the blade tip 20 using a Venturi effect by increase the velocity of cooling fluid near the tip of the generally elongated blade 14.

As shown in FIG. 2, the generally elongated blade may include an exhaust orifice 32 in the blade tip 20, positioned such that the first opening 34 of the exhaust orifice 32 is in fluid communication with the trailing edge cooling cavity 28 and the second opening 36 of the exhaust orifice 32 is located in an outer surface 38 of the blade tip 20. An impingement rib 40 may extend generally spanwise within the generally elongated blade 14 and separate the leading edge cooling cavity 26 from the trailing edge cooling cavity 28. An impingement orifice 42 may pass through the impingement rib 40. The impingement orifice 42 may be positioned so that the impingement orifice 42 has a first opening 44 in fluid communication with the leading edge cooling cavity 26 and a second opening 46 in fluid communication with the trailing edge cooling cavity 28. The cross-sectional area of the impingement orifice 42 may be larger than the cross-section of the exhaust orifice 32.

Figure 5:
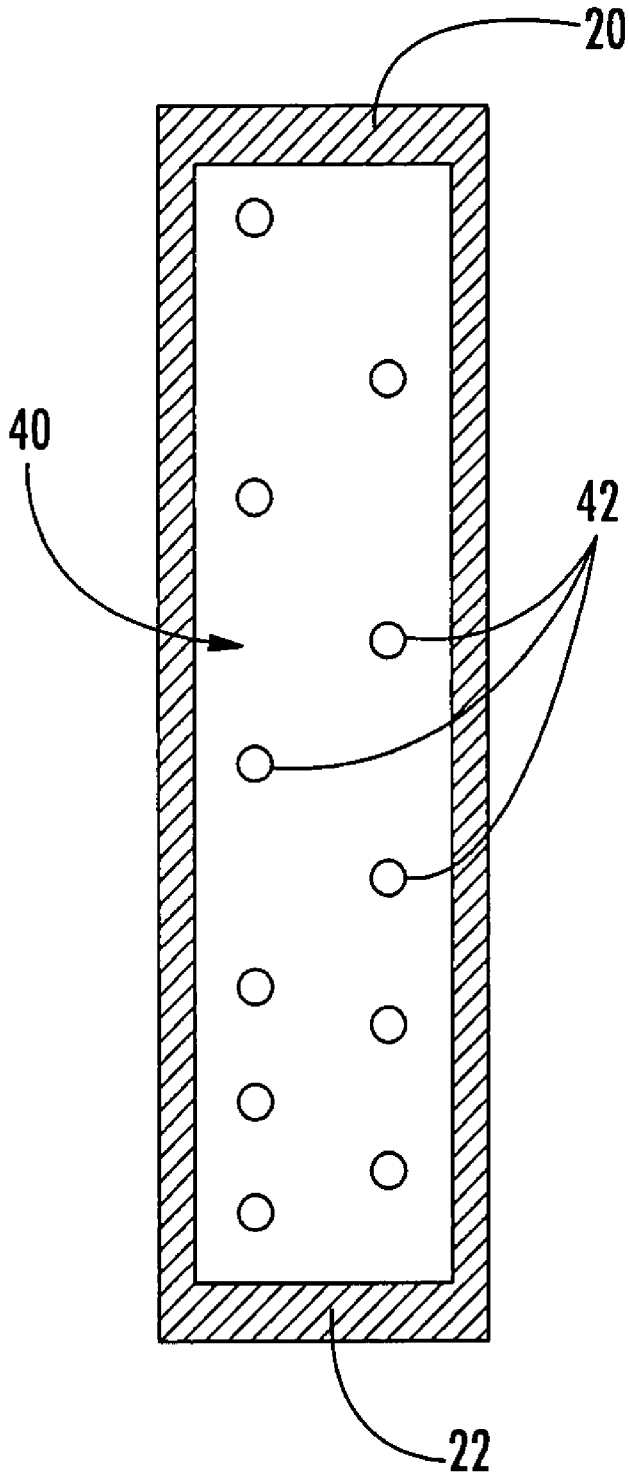
FIG. 5 is a cross-sectional view of the turbine blade of FIG. 2, taken along section line 5-5, that shows an impingement rib having a plurality of impingement orifices asymmetrically distributed therein.
Figure 6:
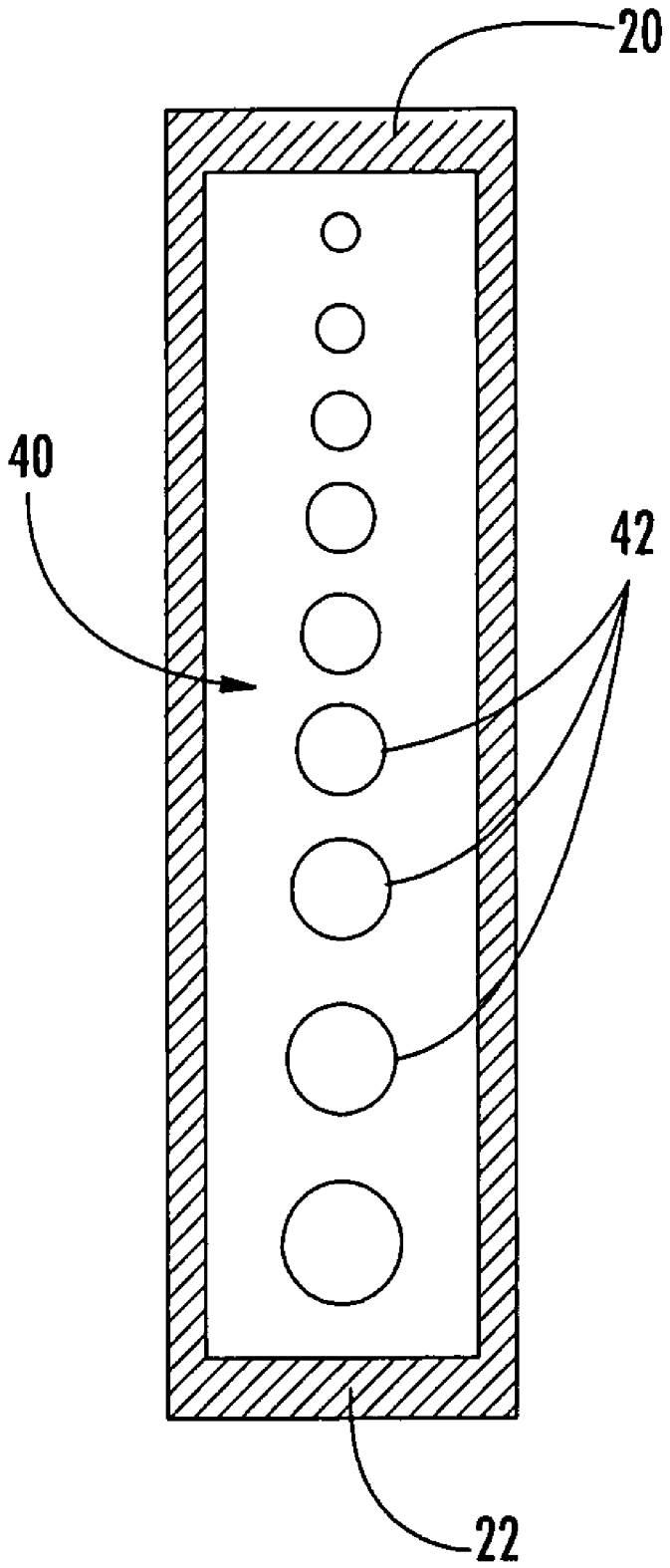
FIG. 6 is a cross-sectional view of the turbine blade of FIG. 2, taken along section line 6-6, that shows an impingement rib having a plurality of impingement orifices with decreasing cross-sectional areas moving from one end to the other.

In one embodiment, the turbine airfoil 10 may include a plurality of impingement orifices 42. As shown in FIGS. 5 & 6, the impingement orifices 42 may be asymmetrically distributed along the length of the impingement rib 40. As shown in FIG. 5, the density of the impingement orifices 42 may decrease moving from the end of the impingement rib 40 proximate the platform 22 toward the blade tip 20. The cross-sectional area of the impingement orifices 42 may decrease moving from the end of the impingement rib 40 proximate the platform 22 toward the blade tip 20, as shown in FIG. 6. The cross-sectional area of the impingement orifices 42 may decrease non-linearly, as shown in FIGS. 5 & 6. The impingement orifices 42 may be any appropriate shape including, but not limited to, circular, oval, triangular, rectangular, and others.

Figure 7:
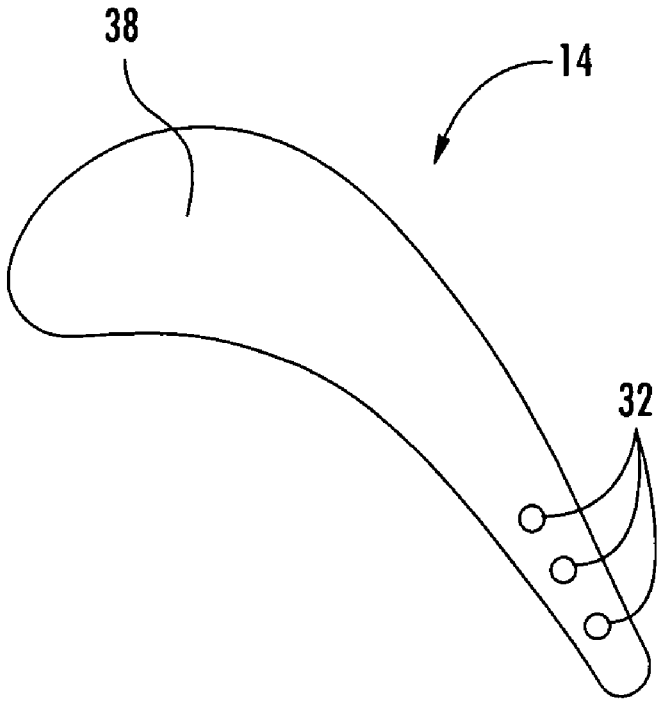
FIG. 7 is an end view of the turbine blade of FIG. 1 that depicts the blade tip having an plurality of exhaust orifices asymmetrically distributed therein.
Figure 8:
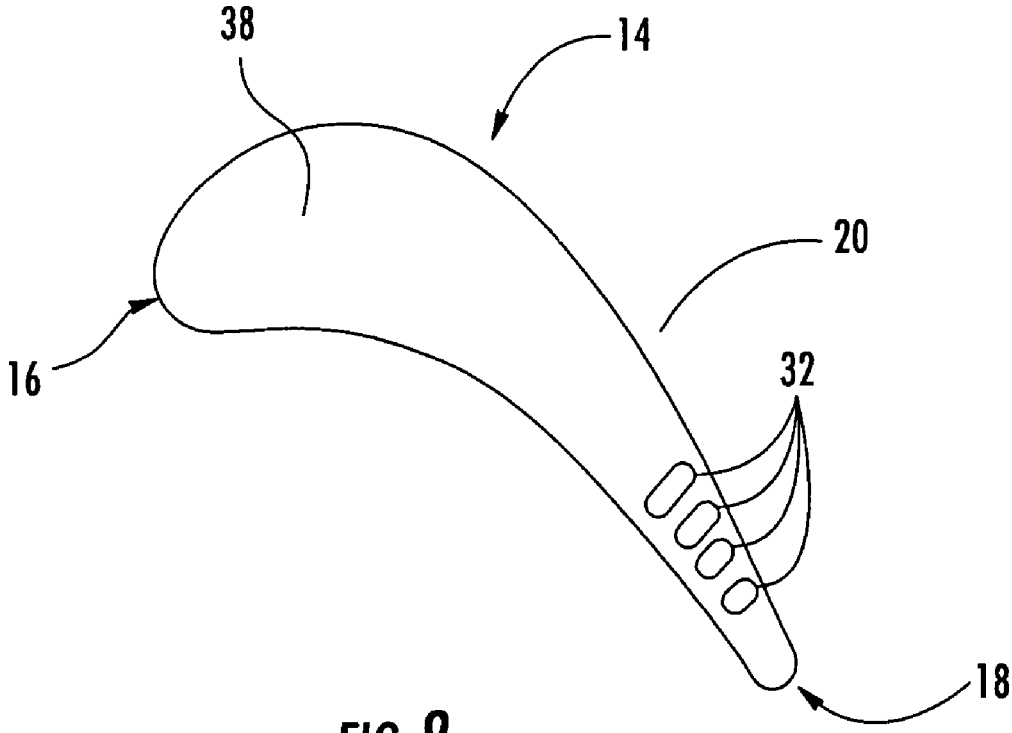
FIG. 8 is an end view of the turbine blade of FIG. 1 that depicts the blade tip having an plurality of oval-shaped exhaust orifices asymmetrically distributed therein.

The turbine airfoil 10 may include a plurality of exhaust orifices 32 in the blade tip 20, as shown in FIGS. 7 & 8. The total cross-sectional area of the plurality of impingement orifices 42 may be less than the total cross-sectional area of the plurality of exhaust orifices 32. As shown in FIGS. 7 & 8, the plurality of exhaust orifices 32 may be distributed asymmetrically along the length of the blade tip 20. The exhaust orifices 32 may be any appropriate shape including, but not limited to, circular, oval, triangular, rectangular, and others.

As shown in FIGS. 3 & 4, the leading edge cooling cavity 26 may be designed such that the cross-sectional area of the leading edge cooling cavity 26 taken generally orthogonal to the radial axis 30 of the generally elongated blade 14 decreases moving from the radially inward end of the leading edge cooling cavity 26, as shown in FIG. 3, toward the radially outward end of the leading edge cooling cavity 26, as shown in FIG. 4. The cross-sectional area of the leading edge cooling cavity 26 may decrease in a non-linear manner. In addition, cross-sectional area of the leading edge cooling cavity 26, may remain constant or even decrease moving from the radially inward end of the leading edge cooling cavity 26 toward the radially outward end of the leading edge cooling cavity 26.

In order to cool the trailing edge 18 of cooled rear stage turbine blades 10, a leading edge cooling cavity 26 may be in fluid communication with the trailing edge cooling cavity 28. Cooling fluid may be fed into the leading edge cooling cavity 26, or any other channel adjacent to the trailing edge cooling cavity 28, by a compressor (not shown). Cooling fluid may flow from the leading edge cooling cavity 26 through the impingement orifices 42 and impinge upon the wall of the trailing edge cooling cavity 28 that forms the trailing edge 18. Additional cooling fluid may enter the trailing edge cooling cavity 28 from any other channel adjacent to the trailing edge cooling cavity 28. The trailing edge cooling system 12 is designed such that cooling fluid entering the trailing edge cooling cavity 28 travels radially outward toward the tip 20 of the generally elongated blade 14 and exits through the exhaust orifices 32.

Although not shown, there may be more than two cooling cavities within the generally elongated blade 14. As used herein, the trailing edge cooling cavity 28 is the cooling cavity most proximate the trailing edge 18. As used herein, the leading edge cooling cavity 26 is adjacent to the trailing edge cooling cavity 28 and in fluid communication with the trailing edge cooling cavity 28 by at least one impingement orifice 42. The leading edge cooling cavity 26 will be more proximate the leading edge 16 than the trailing edge cooling cavity 28, however, the leading edge cooling cavity need not be the cooling cavity most proximate the leading edge 16.

Impingement cooling, particularly when combined with convection cooling, is recognized as being superior to convection cooling alone. The present invention provides high velocity impingement cooling proximate to the trailing edge 18 without the need for channels exiting through the trailing edge 18. This approach may be superior to approaches using channels that exit through the trailing edge 18 because the use of channels in the trailing edge 18 weakens the trailing edge 18, which is vulnerable to creep due to high loads and insufficient cooling even without exhaust chambers extending through the trailing edge 18. The trailing edge cooling cavity 28 may be free of channels that exhaust fluid through the trailing edge 18.

The cross-sectional area of the trailing edge cooling cavity 28 taken generally orthogonal to the radial axis 30 of the generally elongated blade 14 may increase from the end of the generally elongate blade 14 proximate the platform 22 toward the blade tip 20. Using this approach, the turbine blade 10 trailing edge cooling cavity 28 may be designed to ensure the impinging jets of cooling fluid do not get distorted by the flow of cooling fluid generally parallel to the radial axis 30, i.e. the radial flow. In particular, the cross-sectional area of the trailing edge cooling cavity 28 may increase to maintain the radial velocity of cooling fluid in the trailing edge cooling cavity 28 relatively constant from the end 48 of the trailing edge cooling cavity 28 proximate the platform 22 to the end 50 of the trailing edge cooling cavity 28 proximate the blade tip 20.

There are several parameters that may be used to maintain the non-impinging cooling fluid in the trailing edge cooling cavity 28 at a relatively constant radial velocity. In order to maintain the proper pressure differential between the leading edge cooling cavity 26 and the trailing edge cooling cavity 28, the cooling fluid in the trailing edge cooling cavity 28 must exit through the exhaust orifices 32. As cooling fluid in the leading edge cooling cavity 28 passes into the trailing edge cooling cavity 28, an equal mass of cooling fluid must exit through the exhaust orifices 32. Thus, one way to maintain cooling fluid in the trailing edge cooling cavity 28 at a relatively constant radial velocity is to have the cross-sectional area of the trailing edge cooling cavity 28 increase in relation to the number and size of the impingement orifices 42. Maintaining the cooling fluid in the trailing edge cooling cavity 28 at a relatively constant radial velocity improves the impingement effect created by the impingement orifices 42 by reducing distortion and diffusion of the jets of cooling fluid impinging on the wall of the trailing edge cooling cavity 28 proximate to the trailing edge 18.

Based on the foregoing, it will be recognized that a turbine blade 10 designed may utilize many parameters to properly implement the trailing edge cooling system 12 of the present invention. The trailing edge cooling system 12 may be designed to have a pressure differential between the leading edge cooling cavity 26 and the trailing edge cooling cavity 28 such that the cooling fluid passes through the impingement orifices 42 with a velocity sufficient for impingement cooling of the wall of the trailing edge cooling cavity 28 proximate to the trailing edge 18. Whether the velocity of the cooling fluid is sufficient for impingement cooling is, in part, a function of the distance between the second opening 44 of the impingement orifice 42 and the wall of the trailing edge cooling cavity 28 proximate to the trailing edge 18. Accordingly, the design of a trailing edge cooling system 12 may reflect a proper balance between the velocity of the impinging cooling fluid, the radial velocity of non-impinging cooling air in the trailing edge cooling cavity 28, and the distance between the second opening 46 of the impingement orifice 42 and the wall of the trailing edge cooling cavity 28 proximate the trailing edge 18.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine blade, comprising:

a generally elongated blade having a leading edge, a trailing edge, and a tip at a first end;

a platform generally orthogonal to the generally elongated blade and proximate an end of the generally elongated blade opposite the tip;

a leading edge cooling cavity disposed generally spanwise within the generally elongated blade and having a portion located proximate the leading edge;

a trailing edge cooling cavity disposed generally spanwise within the generally elongated blade and having a portion located proximate the trailing edge, wherein a cross-sectional area of the trailing edge cooling cavity taken generally orthogonal to a radial axis of the generally elongated blade generally increases moving from a radially inward end of the trailing edge cooling cavity to a radially outward end of the trailing edge cooling cavity;

an exhaust orifice in the blade tip, positioned such that a first opening of the exhaust orifice is in fluid communication with the trailing edge cooling cavity and a second opening of the exhaust orifice in an outer surface of the generally elongated blade;

an impingement rib separating the leading edge cooling cavity from the trailing edge cooling cavity and extending generally spanwise along the generally elongated blade; and an impingement orifice in the impingement rib, positioned such that a first opening of the impingement orifice is in fluid communication with the leading edge cooling cavity and a second opening of the impingement orifice is in fluid communication with the trailing edge cooling cavity, wherein the cross-sectional area of the exhaust orifice is larger than the cross-sectional area of the impingement orifice.

2. The turbine blade of claim 1, wherein the impingement orifice further comprises a plurality of impingement orifices.

3. The turbine blade of claim 2, wherein the plurality of impingement orifices are asymmetrically distributed along the impingement rib.

4. The turbine blade of claim 3, wherein a density of the impingement orifices decreases moving from the end of the generally elongated blade proximate the platform toward the tip.

5. The turbine blade of claim 2, wherein a cross-sectional area of the impingement orifices decreases moving from the end of the generally elongated blade proximate the platform toward the tip.

6. The turbine blade of claim 5, wherein the cross-sectional area of the impingement orifices decreases non-linearly.

7. The turbine blade of claim 2, wherein the exhaust orifice further comprises a plurality of exhaust orifices.

8. The turbine blade of claim 7, wherein a total cross-sectional area of the plurality of impingement orifices is less than a total cross sectional area of the plurality of exhaust orifices.

9. The turbine blade of claim 7, wherein the plurality of exhaust orifices are distributed asymmetrically along the blade tip.

10. The turbine blade of claim 7, wherein cross-sectional areas of the impingement orifices decrease moving from the radially inward end of the generally elongated blade proximate the platform toward the blade tip.

11. The turbine blade of claim 10, wherein the cross-sectional area of the impingement orifices decreases non-linearly.

12. The turbine blade of claim 1, further comprising a plurality of exhaust orifices in the blade tip.

13. The turbine blade of claim 1, wherein a cross-sectional area of the leading edge cooling cavity taken generally orthogonal to the radial axis of the generally elongated blade decreases moving from a radially inward end of the leading edge cooling cavity to a radially outward end of the leading edge cooling cavity.

14. The turbine blade of claim 13, wherein the cross-sectional area of the leading edge cooling cavity decreases in a non-linear manner.

15. A turbine blade, comprising:

a generally elongated blade having a leading edge, a non-perforated trailing edge, and a tip at a first end;

a platform generally orthogonal to the generally elongated blade and proximate an end of the generally elongated blade opposite the tip;

a leading edge cooling cavity disposed generally spanwise within the generally elongated blade and having a portion located proximate the leading edge;

a trailing edge cooling cavity disposed generally spanwise within the generally elongated blade and having a portion located proximate the trailing edge, wherein a cross-sectional area of the trailing edge cooling cavity taken generally orthogonal to a radial axis of the generally elongated blade generally increases moving from a radially inward end of the trailing edge cooling cavity to a radially outward end of the trailing edge cooling cavity;

a plurality of exhaust orifices in the blade tip, positioned such that a first opening of each of the exhaust orifices is in fluid communication with the trailing edge cooling cavity and a second opening of each of the exhaust orifices in an outer surface of the generally elongated blade;

an impingement rib separating the leading edge cooling cavity from the trailing edge cooling cavity and extending generally spanwise along the generally elongated blade; and a plurality of impingement orifices in the impingement rib, positioned such that a first opening of each of the impingement orifices is in fluid communication with the leading edge cooling cavity and a second opening of each of the impingement orifices is in fluid communication with the trailing edge cooling cavity, wherein a density of the impingement orifices decreases moving from the end of the generally elongated blade proximate the platform toward the tip.

16. A turbine blade, comprising:

a generally elongated blade having a leading edge, a non-perforated trailing edge, and a tip at a first end;

a platform generally orthogonal to the generally elongated blade and proximate an end of the generally elongated blade opposite the tip;

a leading edge cooling cavity disposed generally spanwise within the generally elongated blade and having a portion located proximate the leading edge;

a trailing edge cooling cavity disposed generally spanwise within the generally elongated blade and having a portion located proximate the trailing edge, wherein a cross-sectional area of the trailing edge cooling cavity taken generally orthogonal to a radial axis of the generally elongated blade generally increases moving from a radially inward end of the trailing edge cooling cavity to a radially outward end of the trailing edge cooling cavity;

a plurality of exhaust orifices in the blade tip, positioned such that a first opening of each of the exhaust orifices is in fluid communication with the trailing edge cooling cavity and a second opening of each of the exhaust orifices in an outer surface of the generally elongated blade;

an impingement rib separating the leading edge cooling cavity from the trailing edge cooling cavity and extending generally spanwise along the generally elongated blade; and a plurality of impingement orifices in the impingement rib, positioned such that a first opening of each of the impingement orifices is in fluid communication with the leading edge cooling cavity and a second opening of each of the impingement orifices is in fluid communication with the trailing edge cooling cavity, wherein a cross-sectional area of the impingement orifices decreases moving from the end of the generally elongated blade proximate the platform toward the tip.

17. The turbine blade of claim 15, wherein the plurality of exhaust orifices are distributed asymmetrically along the blade tip.

18. The turbine blade of claim 15, wherein a total cross-sectional area of the plurality of impingement orifices is less than a total cross sectional area of the plurality of exhaust orifices.

19. The turbine blade of claim 16, wherein the plurality of exhaust orifices are distributed asymmetrically along the blade tip.

20. The turbine blade of claim 16, wherein a total cross-sectional area of the plurality of impingement orifices is less than a total cross sectional area of the plurality of exhaust orifices.

* * * * *